US009073099B2

(12) United States Patent
Geslot

(10) Patent No.: US 9,073,099 B2
(45) Date of Patent: Jul. 7, 2015

(54) INSTALLATION PROVIDING A TREATMENT JET FOR CLEANING AND/OR DEGREASING MANUFACTURED PARTS

(71) Applicant: Duerr Ecoclean GmbH, Filderstadt (DE)

(72) Inventor: Marcel Geslot, Saint-Christophe en Champagne (FR)

(73) Assignee: Duerr Ecoclean GmbH, Filderstadt (DE)

( * ) Notice: Subject to any disclaimer, the term of this patent is extended or adjusted under 35 U.S.C. 154(b) by 1 day.

(21) Appl. No.: 13/648,164

(22) Filed: Oct. 9, 2012

(65) Prior Publication Data

US 2013/0025635 A1 Jan. 31, 2013

Related U.S. Application Data

(63) Continuation of application No. PCT/FR2011/050810, filed on Apr. 8, 2011.

(30) Foreign Application Priority Data

Apr. 9, 2010 (FR) ..... 10 01485

(51) Int. Cl.

| | |
|---|---|
| ***B08B 3/00*** | (2006.01) |
| ***B08B 3/02*** | (2006.01) |
| ***B05B 1/04*** | (2006.01) |
| ***B05B 7/06*** | (2006.01) |
| ***B05B 7/08*** | (2006.01) |
| ***B08B 3/14*** | (2006.01) |

(52) U.S. Cl.
CPC . *B08B 3/02* (2013.01); *B05B 1/044* (2013.01); *B05B 7/061* (2013.01); *B05B 7/0815* (2013.01); *B05B 7/0876* (2013.01); *B08B 3/14* (2013.01); *B08B 2230/01* (2013.01)

(58) Field of Classification Search
None
See application file for complete search history.

(56) References Cited

FOREIGN PATENT DOCUMENTS

| | | |
|---|---|---|
| DE | 43 34 905 A1 | 4/1995 |
| WO | WO 02/009894 A2 | 7/2002 |

OTHER PUBLICATIONS

EPO machine translation of DE4334905 retrieved on Nov. 15, 2014.*
International Search Report dated Jun. 24, 2011 of international application PCT/FR2011/050810.

* cited by examiner

*Primary Examiner* — Eric Golightly
(74) *Attorney, Agent, or Firm* — Walter Ottesen P.A.

(57) ABSTRACT

The present invention relates to an installation for cleaning and/or degreasing manufactured parts. The installation applicator includes a first outlet nozzle connected to a device for producing vapor in order to produce a central jet consisting of the pressurized water vapor and a second outlet nozzle surrounding the first nozzle. The second nozzle is connected to a device for producing pressurized air in order to produce a peripheral jet consisting of the pressurized air. The nozzles form a composite treatment jet made of the central jet of pressurized water vapor and the peripheral jet of pressurized air with the peripheral jet surrounding the central jet.

10 Claims, 5 Drawing Sheets

INSTALLATION PROVIDING A TREATMENT JET FOR CLEANING AND/OR DEGREASING MANUFACTURED PARTS

CROSS REFERENCE TO RELATED APPLICATIONS

This application is a continuation application of international patent application PCT/FR 2011/050810, filed Apr. 8, 2011, designating the United States and claiming priority from French application 1001485, filed Apr. 9, 2010, and the entire content of both applications is incorporated herein by reference.

FIELD OF THE INVENTION

The present invention relates to the field of the surface treatment of manufactured parts. It relates in particular to installations that enable the cleaning and/or degreasing of manufactured parts, by the use of a treatment jet.

BACKGROUND OF THE INVENTION

Industrial processes for the production of manufactured parts may comprise cleaning and/or degreasing operations, of use in particular prior to certain treatment (painting for example) and/or assembly steps.

For example, it may be necessary to clean the machined parts in order to remove the turnings and/or dust generated during the machining.

It is sometimes necessary to implement degreasing operations in order to remove the oils present on the parts of interest which oils are likely to originate in particular from the machine tools used during their production.

Current cleaning/degreasing techniques consist for the most part in applying a jet of liquid with washing solution, or a jet of vapor to the parts to be treated.

For example, document WO 02/09894 describes a system in which the parts to be cleaned are subjected to a treatment jet consisting of a mixture of propellant gas and vapor.

For this purpose, this cleaning system comprises an application head comprising a tubular body for conducting the propellant gas, housed in which is an inner tube for conducting the vapor.

In operation, the vapor is delivered within the tubular body so as to ensure the mixing of the two fluids before the spraying thereof onto the part to be treated through a single outlet orifice.

Alternatively or additionally, these parts may also be submerged in a vessel filled with a treatment liquid.

The parts thus cleaned/degreased must then be subjected to a drying operation in order to remove the residual surface liquids.

However, these cleaning/degreasing installations do not ensure an optimal treatment of the parts; furthermore, they are not optimal from an energy efficiency point of view, and they often consume relatively large amounts of treatment fluid, in particular in the case of the treatment of parts having large dimensions, for example such as those used for the production of wind turbine structures (bearings, slewing rings and the constituent parts of the gearboxes, etc.).

It should be noted here that a high consumption of treatment fluid will again reduce the energy efficiency of the installations, due to the energy needed, on the one hand, to dry the parts after treatment, and on the other hand to recycle the recovered treatment fluids.

SUMMARY OF THE INVENTION

The installation of the invention includes means for producing pressurized treatment fluids, which comprise (i) means for producing a first treatment fluid including pressurized steam, and (ii) means for producing a second treatment fluid made up of pressurized air; and, a treatment space equipped with application means connected to the means for producing pressurized treatment fluids, for the application of pressurized treatment fluids in the form of a jet to the manufactured parts, so as to ensure the cleaning thereof and/or the degreasing thereof.

In this installation, the application means comprise, on the one hand, at least one first outlet nozzle connected to the means for producing steam, for the application of a central jet consisting of the pressurized steam and, on the other hand, at least one second outlet nozzle surrounding the first nozzle or nozzles, connected to the means for producing pressurized air, for the application of a peripheral jet consisting of the pressurized air, so as to spray, onto the manufactured parts, a treatment jet consisting, on the one hand, of the central jet consisting of the pressurized steam and, on the other hand, of the peripheral jet consisting of the pressurized air, surrounding the central jet.

In the present installation, the fluids used are not mixed before being released into the atmospheric environment.

The central steam jet is protected by the peripheral air jet.

Without being tied to any theory, the peripheral air jet prevents the dilution of the energy of the central steam jet into the atmosphere, linked to the pressure drops as a result of the penetration speed of a fluid into the atmosphere.

This system with a peripheral air jet therefore has a twofold effect: (i) the protection of the steam, with preservation of its useful energy for the cleaning (in particular degreasing) operations and (ii) provision of a driving power that has a high-impact mechanical effect.

Such an installation ensures a particularly effective surface treatment, in particular a cleaning and a degreasing, of the treated parts.

These steam/air jets produce their full effectiveness during the impact on the part, due to their respective intrinsic properties; then, these two jets are diluted at the blow-out point so as to constitute a final mixture of water and air, the partial vapor pressure of which is preferably less than the saturation vapor pressure.

Furthermore, in practice, the manufactured part proves to not be wetted very much at the end of treatment, and the amount of energy needed for the final drying thereof is thus significantly reduced, or even eliminated.

Moreover, the optimization of the action of the steam makes it possible to reduce the volume of water consumed during the treatment, and consequently enables a reduction of the energy needed not only for the production of steam but also for the recycling thereof.

According to one preferred embodiment, the application means comprise, on the one hand, at least one outlet nozzle connected to the means for producing steam, for the application of a central jet consisting of the pressurized steam and, on the other hand, an outlet ring surrounding the nozzle or nozzles, connected to the means for producing pressurized air, for the application of a peripheral jet consisting of the pressurized air.

In this case, the application means advantageously comprise an application head comprising a body composed of an upstream socket and a downstream skirt, which body is equipped with an upstream/downstream through-housing for the circulation of the pressurized air, which skirt comprises an inner surface that defines an internal volume housed in which is an element that forms a distributor, which distributor incorporates one or more distributing ducts each comprising two ends: an upstream end connected to the steam-production means and a downstream end terminated by an outlet nozzle, and the application head comprises a peripheral duct for the movement of the pressurized air that is delimited by the outer surface of the distributor and the inner surface of the skirt, the peripheral duct being terminated downstream by the outlet ring for the pressurized air.

According to one embodiment the upstream ends of the distributing ducts meet at a chamber that forms a collector connected to the steam-production means.

According to another embodiment, the distributor delimits a single distributing duct, the downstream end of which forms an outlet nozzle, which distributor comprises an additional means for adjusting the cross section of the outlet nozzle.

The fluid-production means advantageously co-operate with means for the recovery of water and/or of thermal energy contained in the treatment space.

The present invention also relates to an application head for spraying a treatment jet, which application head comprises, on the one hand, at least one first outlet nozzle intended to be connected to the means for producing steam, for the application of a central jet consisting of the pressurized steam and, on the other hand, at least one second outlet nozzle, advantageously an outlet ring, surrounding the first nozzle or nozzles, intended to be connected to the means for producing pressurized air, for the application of a peripheral jet consisting of the pressurized air, so as to spray, onto the manufactured parts, a treatment jet consisting, on the one hand, of the central jet consisting of the pressurized steam and, on the other hand, of the peripheral jet consisting of the pressurized air, surrounding the central jet.

The invention also relates to a process for cleaning and/or degreasing manufactured parts within an installation as defined above, which process comprises a treatment operation during which the application means spray, onto the manufactured parts, a treatment jet consisting, on the one hand, of a central jet consisting of the pressurized steam and, on the other hand, of a peripheral jet consisting of the pressurized air, surrounding the central jet.

Other advantageous features, which may be taken in combination or independently of one another, are expanded upon below:

- the air jet consists of a continuous fluid space surrounding the steam jet;
- the internal contour of the air jet and the external contour of the steam jet each have a shape chosen from (i) a general elongated shape, for example a rectangular or oblong shape, or (ii) a general circular shape;
- the steam jet consists of saturated steam, and the air jet consists of dry air;
- the steam jet comprises, at the application means the following features: a mass flow rate between 60 and 200 kg/h, a pressure between 4 and 15 bar, a temperature between 150° C. and 250° C., a velocity between 30 and 80 m/s, and a quality of less than 1; the air jet comprises, at the application means, the following features: a volume flow rate between 0.2 and 0.8 $m^3/s$, a temperature between 30° C. and 70° C., a degree of relative humidity between 5% and 30%, and a velocity between 50 and 180 m/s (preferably between 50 and 100 m/s); generally, the velocity of the steam jet is advantageously less than the velocity of the air jet (or the velocity of the air jet is advantageously greater than the velocity of the steam jet);
- the process comprises at least one step during which the volume flow rate of steam and the volume flow rate of air that make up the treatment jet are controlled so as to adjust the partial pressure of steam of the treatment space of the installation;
- the process comprises a final step of shutdown of the application of the steam jet while continuing the application of the air jet, so as to dry the treated part and the treatment space of the installation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
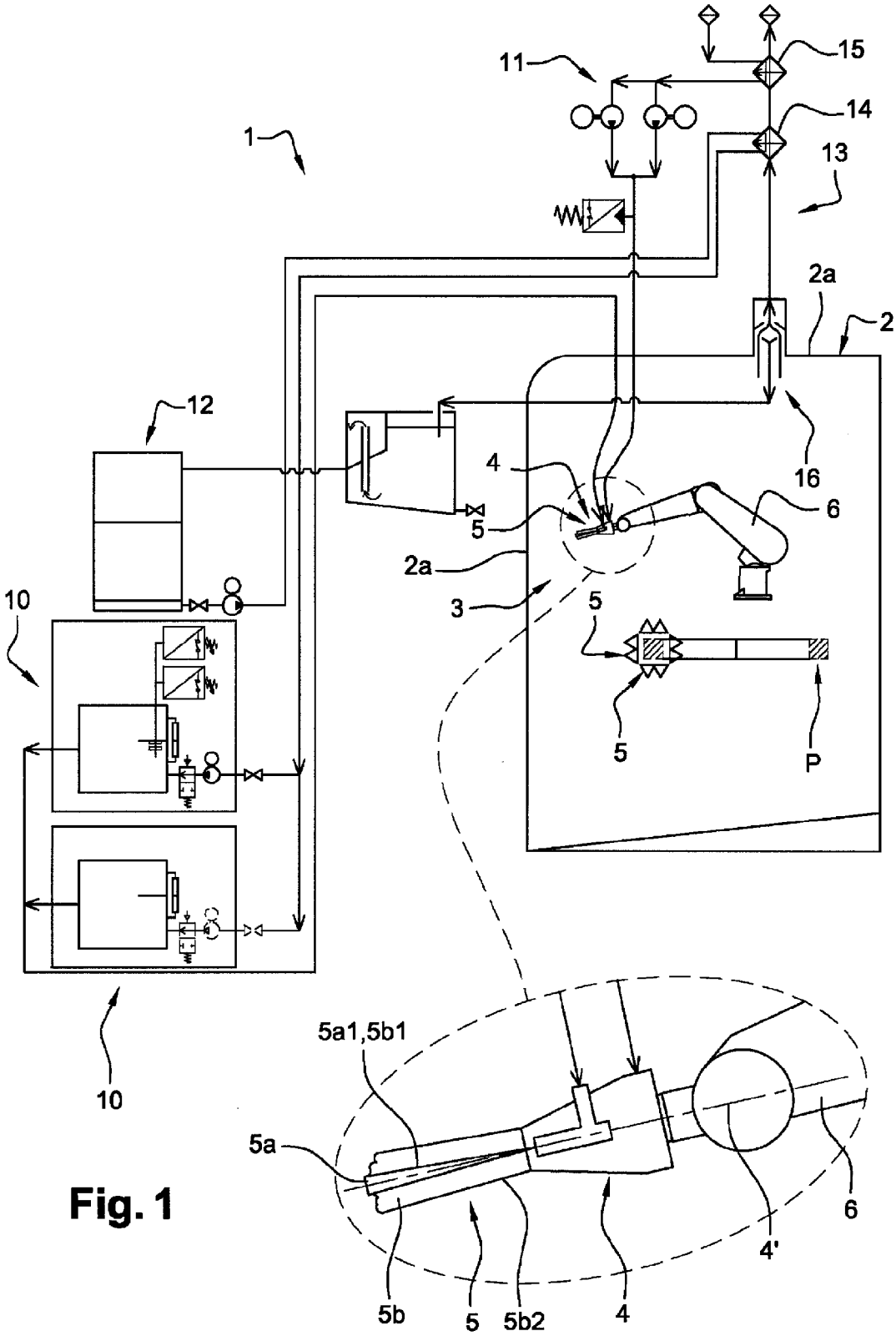
FIG. 1 is a schematic of a cleaning/degreasing installation according to the invention, represented in the form of a flow diagram with an enlarged detailed view of the treatment jet application means.

The cleaning/degreasing installation 1, represented here schematically in FIG. 1, is particularly suitable for the treatment of manufactured parts of large dimensions, such as the mechanical parts for wind turbines (in particular bearings, slewing rings and the constituent parts of the gearboxes).

The expression "part of large dimensions" is understood for example, without being limited in any way, to mean a casing having a length of 5 m, a width 3 m and a height of 2 m, which may weigh up to 7 metric tons; it is also understood to mean a slewing ring, the diameter of which is between 2 m and 4 m, for a weight of 1.5 to 3 t.

Such a mechanical part is illustrated schematically in FIG. 1, denoted by a reference letter P.

The installation 1 comprises a cabin 2 having a set of walls 2*a* (in particular a ceiling and a ring of side walls) which together define a treatment space 3.

The part P to be treated is introduced into this treatment space 3 in order to carry out the cleaning and/or degreasing, or even drying operations as expanded upon below.

By way of indication, the volume of this treatment space 3 is advantageously between 30 and 100 $m^3$.

In order to carry out these treatment operations, the space 3 is equipped with means 4 for the application of a treatment jet 5 to the part P.

The application means 4 advantageously comprises an application head, advantageously comprising a structure as described in greater detail below in connection with FIGS. 2 to 8 or 9 to 12.

This application head 4 is borne here by a device 6 enabling the maneuvering thereof in the space, so as to clean/degrease the whole of the surface of the part P with the treatment jet 5.

This maneuvering device 6 consists, for example, of a robotic arm, or of a system having one or two digitized axes.

The treatment jet 5 sprayed by the application head 4 according to the invention provides for a cleaning and/or a degreasing of the part P, with particularly advantageous effectiveness and efficiency.

For this purpose, and as shown schematically in the detailed view of FIG. 1, the treatment jet 5 consists of two fluids that are juxtaposed and sprayed in one and the same direction, advantageously coaxially or at least approximately coaxially with respect to one another, namely:

(i) a central jet 5*a* consisting of pressurized steam, and (ii) a peripheral jet 5*b* consisting of pressurized air, surrounding the central jet 5*a*.

The steam jet 5*a* is here solid, and it has a cross section delimited by an external contour 5*a*1.

The air jet 5*b* is hollow; it has a cross section delimited by an internal contour 5*b*1 and an external contour 5*b*2.

The internal contour 5*b*1 of the air jet 5*b* thus delimits a volume within which the steam jet 5*a* is sprayed.

For an optimal action of the treatment jet 5, the peripheral air jet 5*b* is sprayed over the entire perimeter of the central jet 5*a*.

This air jet 5*b* advantageously consists of a continuous fluid space; its internal contour 5*b*1 and its external contour 5*b*2 are thus continuous.

Still for an optimal action, the internal contour 5*b*1 of the air jet 5*b* matches as well as possible the external contour 5*a*1 of the steam jet 5*a*.

Alternatively, the external contour 5*a*1 of the steam jet 5*a* and the internal contour 5*b*1 of the air jet 5*b* may be at a distance from one another.

As described below in connection with FIGS. 2 to 8, the internal contour 5*b*1 of the air jet 5*b* and the external contour 5*a*1 of the steam jet 5*a* each have a general elongated shape, for example a rectangular or oblong shape.

As expanded upon below, the central jet 5*a* may have a general elongated shape, for example a general rectangular or oblong shape. The air jet 5*b* then also has a cross section of general elongated shape, for example of flattened annular shape.

Alternatively, not represented, the internal contour 5*b*1 of the air jet 5*b* and the external contour 5*a*1 of the steam jet 5*a* may have a general circular shape. In this case, the cross section of the steam jet 5*a* is of a general circular shape, surrounded by an air jet 5*b* of general circular annular shape.

The term "steam" is understood to mean water in the gaseous state. This concept covers both (i) saturated or wet steam and (ii) dry steam.

The expressions "saturated steam" or "wet steam" are understood to mean steam comprising or transporting a certain amount of water particles in suspension. It is also understood to mean a mixture of gas and liquid.

The expression "dry steam" is understood to mean steam devoid of, or at least virtually devoid of, water in liquid form.

The characteristics of the steam may be defined by various physical quantities, in particular pressure, temperature, density and quality.

The "quality" or "steam quality" or "vapor quality" makes it possible to express the degree of humidity of the steam (or the proportion of vapor (gas) in the gas/liquid mixture) and to classify this fluid between saturated steam/dry steam.

This quality is defined in the following manner: mass of dry steam/(mass of dry steam+mass of water in liquid phase).

This quality may also be defined by the following formula:

$$x=(v-u')/(u''-u'),$$

in which u' is the density of the liquid, u" is the density of the steam, v is the volume of the mixture.

Preferably, the steam is said to be "saturated" or "wet" when its quality is less than 1.

In order to ensure an optimal treatment, at the application head 4 or at the outlet of this head 4, the steam jet 5*a* advantageously comprises the following features:

- a mass flow rate between 60 and 200 kg/h,
- a pressure between and 4 and 15 bar,
- a temperature between 150° C. and 250° C., and preferably from 150° C. to 200° C.,
- a velocity between 30 and 80 m/s, and preferably 30 and 60 m/s and
- a quality of less than 1, preferably between 0.75 and 0.95, and preferably greater than 0.9 and more preferably of the order 0.95.

Moreover, the term "air" component of the peripheral jet 5*b*, is understood for example to mean a fluid, the composition of which is identical, or at least similar, to that of atmospheric air (that is to say with a molar or volume fraction of the order of 80% dinitrogen and 20% dioxygen).

The features of the air may also be defined by various physical quantities, in particular pressure, temperature, density and degree of relative humidity.

The relative humidity of the air (or degree of hygrometry) corresponds to the ratio of the partial pressure of water vapor contained in the air to the saturation vapor pressure (or vapor pressure) at the same temperature and pressure.

Preferably, the air of the peripheral jet 5*b* consists of dry air advantageously obtained from atmospheric air raised in temperature in order to reduce its relative humidity.

In this case, at the application head 4 or at the outlet of this head 4, the air jet 5*b* advantageously comprises the following features:

- a volume flow rate between 0.2 and 0.8 $m^3/s$,
- a temperature between 30° C. and 70° C.,
- a degree of relative humidity between 5% and 30%, and
- a velocity between 50 and 100 m/s but which may attain 180 m/s.

By way of indication only, the ratio between, on the one hand, the mass flow rate of the steam expressed in kg/h and, on the other hand, the volume flow rate of the air jet expressed in $m^3/s$, is advantageously between 280 and 460, and preferably of the order of 350 (i.e. for example a mass flow rate of the steam of the order of 140 kg/h, and a volume flow rate of the air jet of the order of 0.4 $m^3/s$).

Still for an optimal effectiveness, the working distance between the application head 4 and the part to be treated P is advantageously between 25 and 250 mm, and preferably between 25 and 100 mm.

As mentioned previously, such a combination of pressurized jets enables a particularly effective and economical cleaning and/or degreasing of the parts P to be treated.

Furthermore, the part P thus treated has a reduced amount of water at its surface, at the end of treatment; it thus has a pre-dried type surface appearance, facilitating its final drying and reducing the energy needed for this purpose.

Moreover, the central steam jet is protected by the peripheral air jet. Without being tied to any theory, the peripheral air jet prevents the dilution of the energy into the atmosphere, linked to the pressure drops as a result of the penetration speed of a fluid into the atmosphere. This system therefore has a two-fold effect: (i) protection of the steam and (ii) provision of a driving power that has a high-impact mechanical effect.

In order to generate the treatment jet 5, the application head 4 is suitably connected with means for production of pressurized treatment fluids, namely:

(i) means 10 for the production of pressurized steam; the latter being intended to constitute the central jet 5*a*, and (ii) means 11 for producing pressurized air, intended to constitute the peripheral jet 5*b*.

The means 10 for producing steam consists, for example, of one or more steam generators of boiler or coil type; they are preferably supplied with water by a buffer tank 12 and/or by a supply of demineralized water or of softened water.

For example, these steam generators are capable of producing up to 140 or 200 kg/hour of steam, (i) at a temperature of 170° C. and with a pressure of 7 bar or (ii) at a temperature of 200° C. and with a pressure of 15 bar.

The means 11 for producing pressurized air advantageously consist of one or more devices of annular turbine type.

They comprise, in particular, means for ensuring the heating of the air, so as to increase its temperature, and reduce its degree of relative humidity.

For example, the air-production means 11 consist of turbines having a power of 11 kW, with a rotational speed of 3 000 rpm and thus are capable of generating a flow rate of 800 $m^3$/hour at a pressure of 300 mbar.

At the same time, the atmosphere of the treatment space 3 is controlled in particular (i) in order to obtain a constant system (equilibrium between the incoming and outgoing mass flow rates), and (ii) in order to prevent, or at the very least limit the steam condensation phenomena, with the problems that would result therefrom (in particular humidification of the cabin 2 and of the manufactured part).

For this, the atmosphere of the treatment space 3 is maintained with the following physical parameters:

- a pressure between 1013 and 1035 mbar,
- a temperature between 30° C. and 80° C. and preferably between 30° C. and 65° C.,
- a degree of relative humidity of between 30% and 80%.

For example, the temperature of the treatment space 3 is of the order of 55° C., with a degree of relative humidity of the order of 70% and with a dew point of the order of 45° C.

These physical parameters of the treatment space 3 are maintained in particular by:

- a suitable control of the air jet 5*b*, especially in terms of flow rate, temperature and degree of humidity; and,
- means 13 for discharging the air/water mixture contained in the internal space 3.

Electronic/computer means equip the installation 1 in order to carry out this control.

It will be noted that in addition to "protecting" the steam jet 5*a*, the air jet 5*b* makes it possible to maintain the partial vapor pressure of the treatment space 3 at a value below the saturation vapor pressure. This feature enables the dry atmosphere to be maintained in the treatment space 3 (the presence of a mist linked to too small an amount of air is therefore avoided).

Alternatively or additionally, the treatment space 3 may also be equipped with additional air inlet(s) in order to adjust the parameters of its atmosphere.

The discharge means 13 may consist of a discharge duct, with pressure drop, adjusted in order to maintain the internal space at an overpressure.

Furthermore, in order to optimize the efficiency of the installation 1, the discharge means 13 are advantageously coupled to means 14, 15, and 16 for the recovery of the water and thermal energy contained in the atmosphere exiting the treatment space 3.

For this purpose, the water/air mixture withdrawn from the treatment space 3 is circulated through two heat exchanger devices, namely:

- an air/water exchanger 14, in order to ensure the heating, or at least the preheating, of the water originating from the buffer tank 12 and that is intended to supply the steam generators 10, so as to facilitate the vaporization thereof, and
- an air/air exchanger 15, in order to ensure the heating, or at least the preheating, of the air intended to be propelled by the annular turbines 11.

Collection means 16 are additionally combined with these discharge means 13 for the recovery of the water contained in the discharged atmosphere and originating from the condensation of the steam during the cooling thereof.

These collection means 16 are connected to the water supply circuit, here to the buffer tank 12, in order to reduce the water consumption of the installation 1.

In practice, the part P is therefore firstly introduced into the cabin 2, within the treatment space 3.

Once in place, the treatment jet 5 is suitably applied to the part P, by means of the head 4 moved in the space by the robot 6.

During this treatment, the pressurized steam jet 5*a* exits from the application head 4 into the annular space delimited by the air jet 5*b*.

The steam jet 5*a* thus ensures the elimination of surface contaminants (particles, oils, etc.). This cleaning/degreasing action is particularly effective with saturated steam: the water droplets capture and/or dilute the contaminants which are removed by runoff from the part P.

The air jet 5*b* protects the steam jet 5*a*; it also ensures (i) the provision of a drive energy having a high-impact mechanical effect, (ii) a mechanical thrust on the water from the part to be treated and (iii) the at least partial evaporation of the residual water at the surface of the part P, which limits the energy needed for the final drying.

The features of the steam jet 5*a* and the maneuvering in the space of the treatment jet 5 are controlled by electronic/computer means, on the basis of a specific program customized for each shape of part P. This treatment program takes into account, in particular, the shape of the part P, and the degree of cleaning/degreasing desired.

At the same time, the volume flow rate of the air jet 5*b* is managed so as to protect the steam jet 5*a*, and also so as to adjust the partial pressure of steam contained in the treatment space 3.

The working distance is adjusted so as to reduce, or even eliminate, mixing between the steam and the air. In practice, and without being limited to any theory, it seems that this mixing only takes place beyond a certain distance with respect to the application head 4, due to the velocity of the jets. Thus, this working distance is adapted to be before the mixing distance.

The manufactured part P is thus subjected to the steam jet 5*a* such that it is sprayed, or at least according to very similar features, without any mixing with the atmosphere of the treatment space 3 or any loss of velocity.

At the end of the treatment, it is advantageous to shut down the spraying of the steam jet 5*a* while continuing the spraying of the air jet 5*b*.

This final air treatment jet makes it possible to reduce the steam partial pressure of the treatment space 3 so as to predry, or even to dry, both the treated part P and the treatment space 3.

Similarly, the low degree of relative humidity of the air jet 5*b* improves the evaporation of the water present on the part P.

This evaporation is further favored by the thermal energy accumulated by the part P during its treatment.

Tests have been carried out with the device according to the invention, for the cleaning of two cylindrical parts having the following dimensions: 1008 mm×174 mm and 590 mm×415 mm.

The treatments made it possible to obtain the degreasing of the two parts with results greater than the DIN standard 38 (40 for one part and 44 for the other) in 12 min; at the end of the treatment, the parts have a temperature of the order of 40° C.

FIGS. 2 to 8 represent one possible embodiment of the application head 4 intended to equip the installation 1 described in connection with FIG. 1.

The terms "upstream" and "downstream" that are used are associated with the direction of travel of the two treatment fluids through this application head 4.

Figure 2:
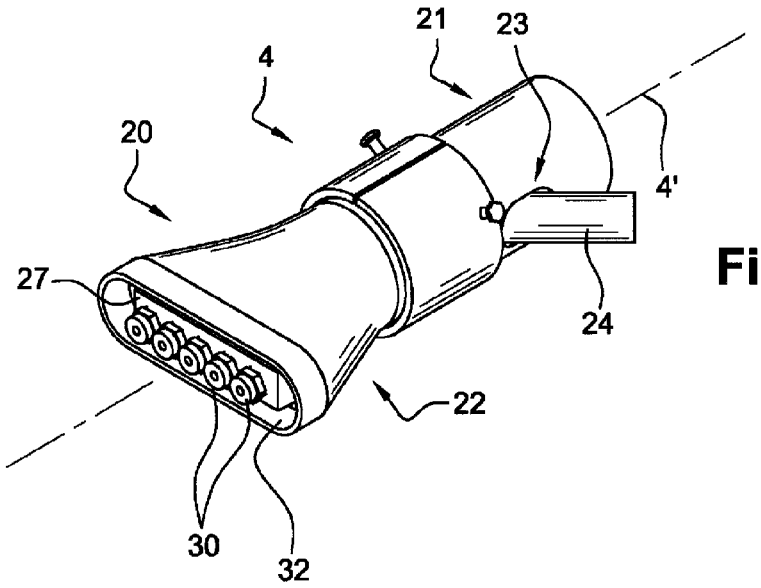
FIG. 2 is a general and perspective view of an embodiment of the application head which may equip the installation according to FIG. 1.
Figure 3:
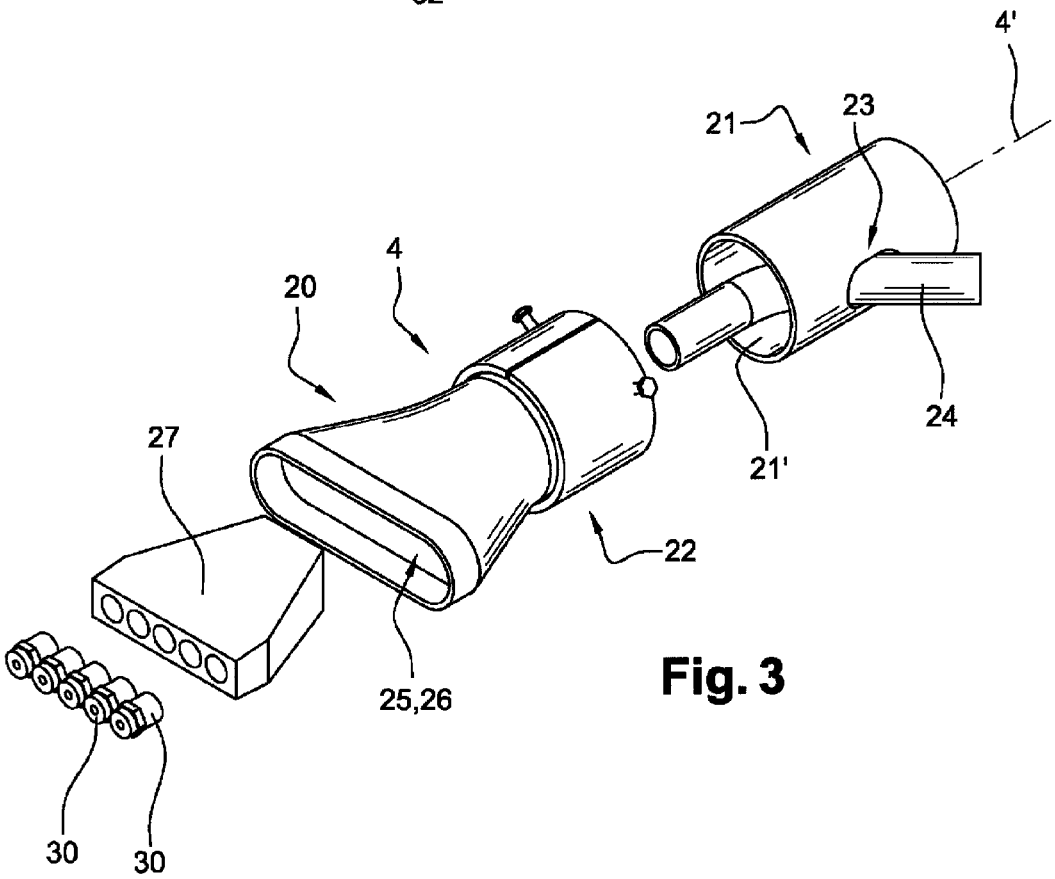
FIG. 3 is an exploded perspective view of the application head of FIG. 2, showing its various constituent parts.

As represented in FIGS. 2 and 3, the application head 4, of longitudinal axis 4' comprises a body 20 composed of an upstream socket 21 and a downstream skirt 22.

Figure 6:
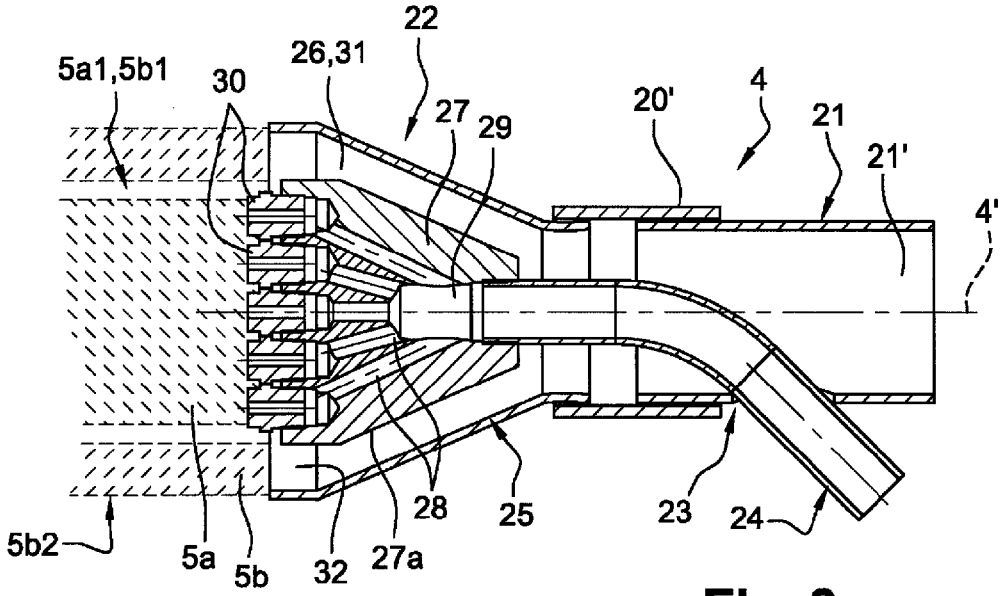
FIG. 6 is a cross-sectional view of the application head of FIGS. 2 to 5 taken along a VI-VI sectional plane in FIG. 5.

These upstream 21 and downstream 22 sections each consist of a part, assembled together hermetically, along the axis of symmetry 4' by mechanical means, for example in the form of a collar 20' (FIGS. 3 and 6). Alternatively, these two sections 21 and 22 may be made of a single piece.

The socket 21 consists of a cylindrical tubular part which delimits an upstream/downstream orifice 21' (FIG. 3) intended to be connected to the pressurized air-production means 11, at its upstream end.

It also comprises an opening 23 which is passed through by a duct 24 connected, on the upstream end, to the steam-production means 10.

Figure 4:
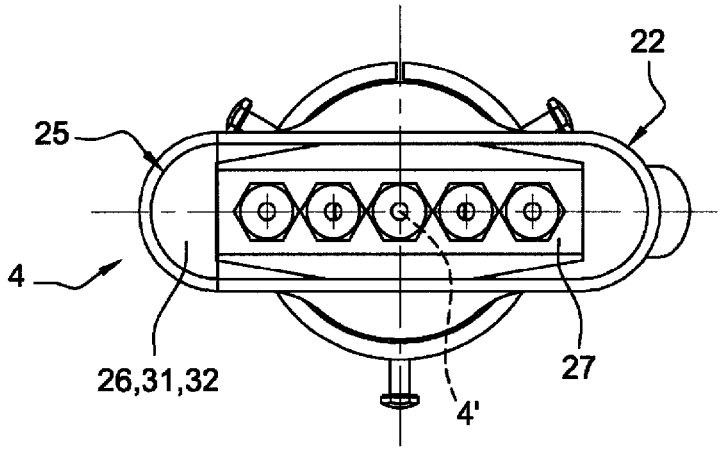
FIGS. 4 and 5 are respectively front and side views of the application head of FIGS. 2 and 3.
Figure 5:
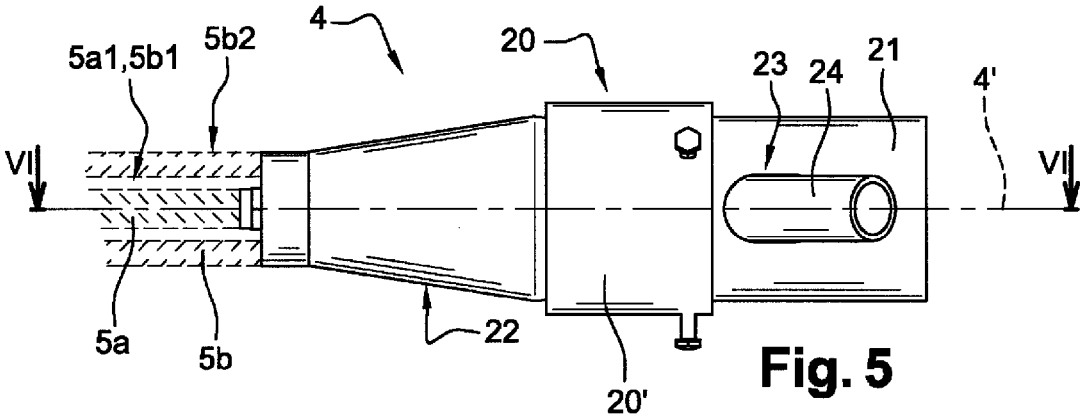

The skirt 22 is also of general tubular shape, changing gradually from an upstream circular cross section to a downstream oblong cross section along the axis of symmetry 4' (shown in FIGS. 4 and 5).

This skirt 22 comprises an inner surface 25, visible in particular in FIGS. 4 and 6, defining an internal volume 26, housed in which is a part 27 that forms a distributor for the steam.

The distributor 27, described in greater detail in connection with FIGS. 7 and 8, consists of a body having an outer surface 27*a* composed of a top face 27*a*1 and of a bottom face 27*a*2, of an upstream face 27*a*3, of a downstream face 27*a*4 and of two side faces 27*a*5.

Figure 7:
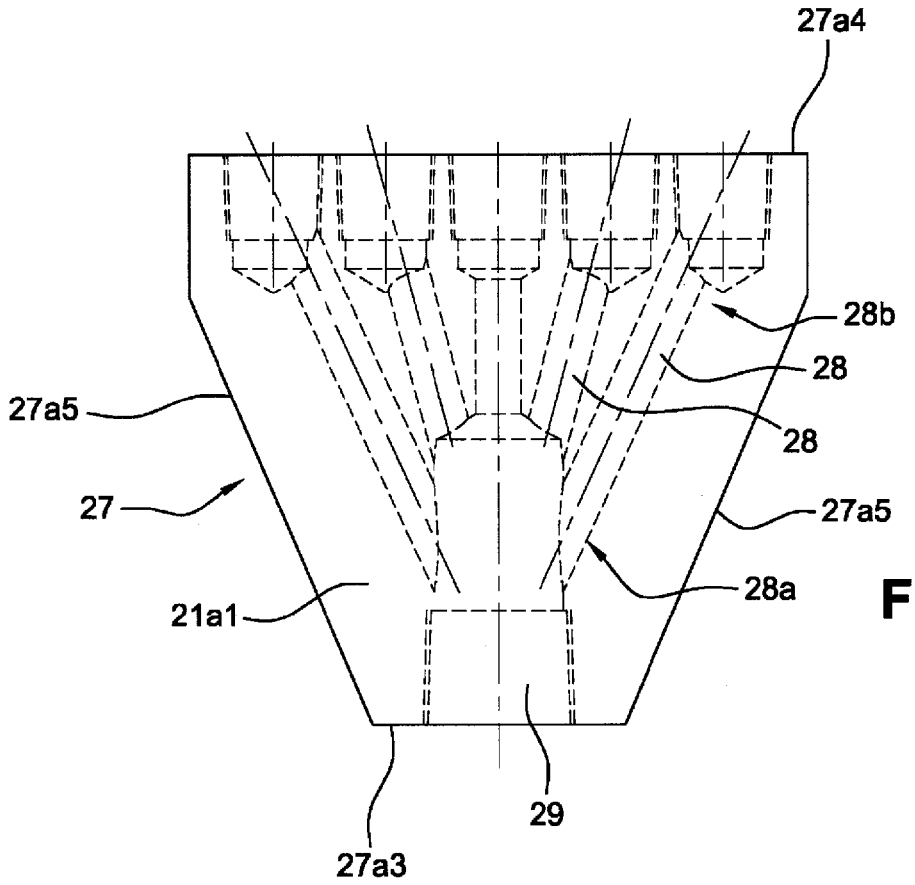
FIGS. 7 and 8 represent the steam distributor equipping the application head according to FIGS. 2 to 6, respectively, seen from the top and seen from the side.

As can be seen in FIG. 7, the upstream face 27*a*3 is less wide than the downstream face 27*a*4, and the side faces 27*a*5 diverge with respect to one another in the direction from the upstream face 27*a*3 toward the downstream face 27*a*4.

Figure 8:
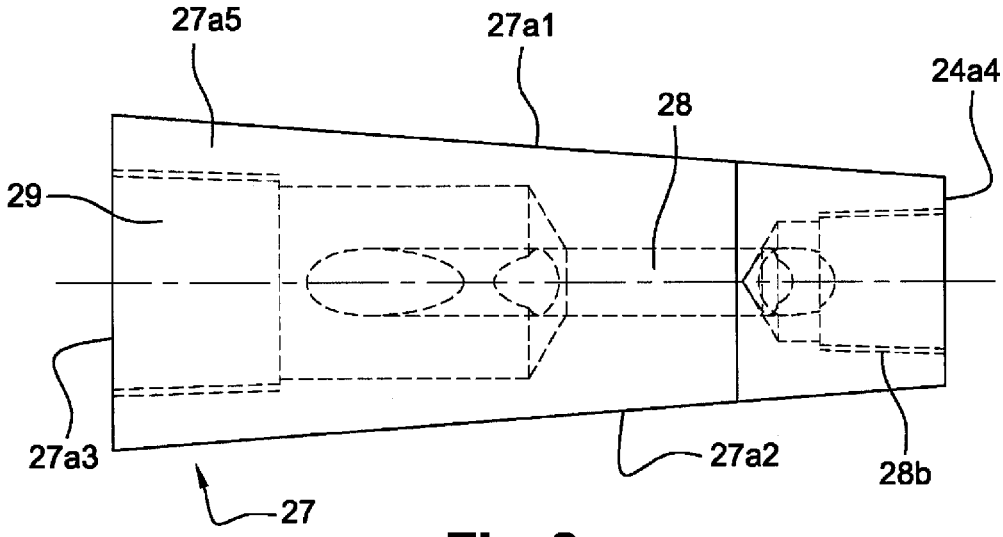
Figure 9:
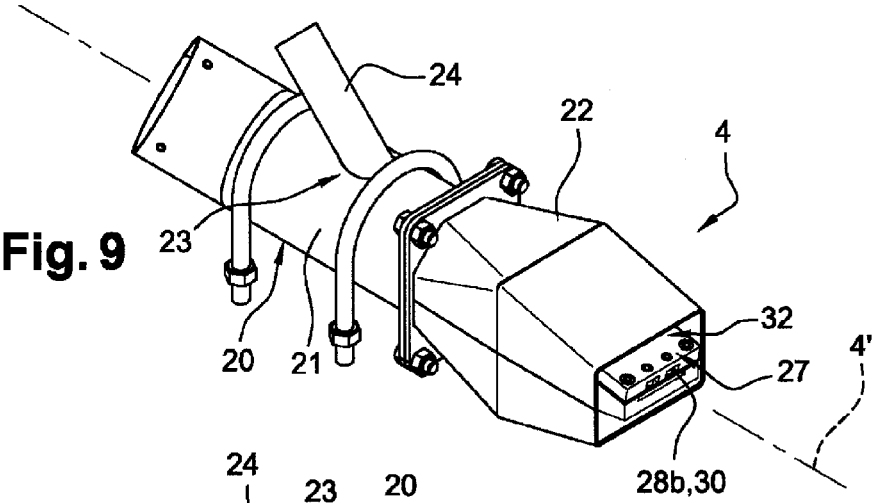
FIG. 9 is a general and perspective view of a second embodiment of the application head which may equip the installation of FIG. 1.

It can also be seen in FIG. 8 that the upstream face 27*a*3 has a height greater than the downstream face 27*a*4.

The distributor 27 also integrates a plurality of distribution ducts 28, here numbering 5, for the movement of steam in the upstream/downstream direction.

These distribution ducts 28 each comprise two ends, one upstream 28*a* and the other downstream 28*b*, located respectively on the side of the upstream face 27*a*3 and downstream face 27*a*4 of the distributor 27.

The upstream ends 28*a* of the various distribution ducts 28 join together at a chamber 29 that forms a collector connected to the downstream end of the aforementioned supply duct 24 (see FIG. 6).

The downstream end 28*b* of these same distribution ducts 28 forms a housing, added into which is an outlet nozzle 30 (visible in particular in FIGS. 3 and 6).

In FIGS. 2 to 9, it can be seen that the various nozzles 30 are distributed over one and the same line.

This particular arrangement makes it possible to obtain a central steam jet 5*a* of general rectangular or oblong shape.

In FIG. 6, it is observed that the outer surface 27*a* of the distributor 27 and the inner surface 25 of the skirt 22 together define a peripheral duct 31 intended to be passed through by pressurized air originating from the socket 21, in the upstream to downstream direction.

This peripheral duct 31 is terminated downstream by an outlet orifice 32 (or outlet nozzle) of annular shape, enabling the production of the pressurized air space surrounding the steam jet 5*a*.

Such a structure enables the production of the treatment jet 5 according to the invention, described previously in connection with FIG. 1 and as represented schematically in FIGS. 5 and 6.

This application head 4 is in particular suitable for the treatment of large surface areas.

FIGS. 9 to 12 represent a second possible embodiment of the application head 4 intended to equip the installation 1 described in connection with FIG. 1.

In order to simplify the description of this second embodiment, the reference characters used above are retained in order to denote the parts whose functions are identical.

This second embodiment differs from that described previously in particular by the structure of its steam distributor.

As shown in FIGS. 9 to 12, the application head 4, of longitudinal axis 4', comprises a body 20 composed of an upstream socket 21 and of a downstream skirt 22.

These upstream 21 and downstream 22 sections each consist of a part, assembled together hermetically along the axis of symmetry 4' by mechanical means, for example bolting. Alternatively, these two sections 21 and 22 may be made of a single piece.

The socket 21 consists of a cylindrical tubular part which delimits an upstream/downstream orifice 21' (FIG. 10), intended to be connected to the pressurized air-production means 11, at its upstream end.

It also comprises an opening 23 which is passed through by a duct 24 connected, on the upstream side, to the steam-production means 10.

The skirt 22 is of general polyhedral tubular shape, gradually changing, in the direction upstream to downstream, from an upstream octagonal cross section to a downstream rectangular cross section along the axis of symmetry 4'.

Figure 10:
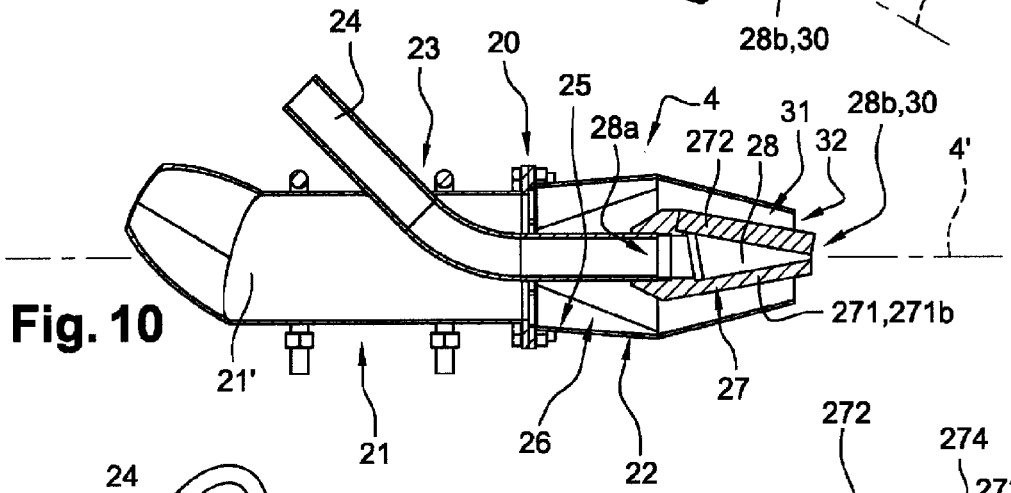
FIG. 10 is a cross-sectional view of the application head of FIG. 9.

This skirt 22 comprises an inner surface 25, visible in FIG. 10, defining an internal volume 26, housed in which is a part 27 that forms a steam distributor.

Figure 12:
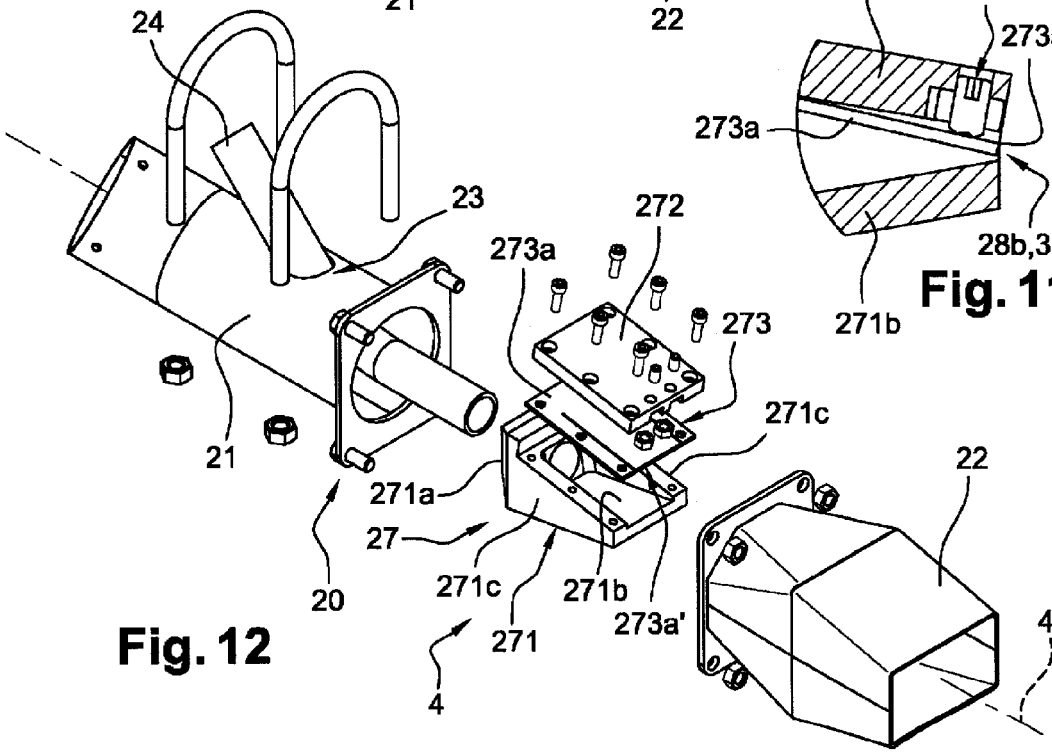
Figure 11:
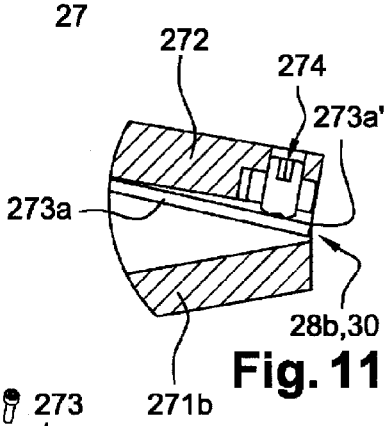
FIG. 11 is a detailed view of the steam outlet nozzle equipping the application head of FIG. 9; and, FIG. 12 is an exploded view, in perspective, of the application head of FIG. 9.

The distributor 27, that can be seen in particular in FIGS. 10, 11 and 12, consists of a body constituted by two assembled parts: a support part 271 forming a cradle, and a complementary part 272.

The support part 271 comprises an assembly of planar walls: —a rear wall 271*a*, hermetically attached to the downstream end of the duct 24 introducing the steam, —a lower wall 271*b*, and—two side walls 271*c*, extending at right angles to the lower wall 271*b*.

The complementary part 272 consists of a plate, hermetically attached, for example using screws, to the free upper edge of the side walls 271*c* of the support part 271.

The lower wall 271*b* of the support part 271 and the complementary part 272, constituting the upper wall of the distributor 27, are here convergent with one another in the upstream to downstream direction.

The distributor 27 delimits a single distribution duct 28, for the movement of steam in the upstream/downstream direction.

This distribution duct 28 comprises two ends, one upstream 28*a* and the other downstream 28*b*. The downstream end 28*b* forms an outlet nozzle 30.

This distribution duct 28 is here of rectangular cross section, with a height that decreases in the upstream to downstream direction. It is delimited by the lower wall 271*b* and side walls 271*c* of the support part 271 and by the complementary part 272.

The outlet nozzle 30 is also of elongated rectangular cross section.

This distributor 27 here comprises additional means for adjusting the cross section, and in particular the height, of the rectangular outlet nozzle 30.

For this, a particular small metal plate 273 is here housed between the support part 271 and the complementary part 272. It is pressed against the lower face of the complementary part 272.

The central portion 273*a* of this small plate 273, extending between the side walls 271*c* of the support part 271, comprises a free end edge 273*a*' that defines the upper edge of the outlet nozzle 30.

This central portion 273*a* can be maneuvered and deformed by elastic pivoting so as to be moved away from the lower face of the complementary part 272.

This deformation enables the adjustment of the distance separating its free end edge 273*a*' from the opposite free end edge of the lower wall 271*b* of the support part 271.

In order to ensure the adjustment of this central portion 273*a*, screws 274 are added to the complementary part 272; these screws 274 are adjustable, jutting out at the lower face of the complementary part 272 and in the direction of the lower wall 271*b* of the support part 271.

In FIG. 10, it is observed that the outer surface of the distributor 27 and the inner surface 25 of the skirt 22 together define the peripheral duct 31 intended to be passed through by the pressurized air originating from the socket 21, in the upstream to downstream direction.

This peripheral duct 31 is terminated downstream by an outlet orifice (or nozzle) 32 of ring shape (here of rectangular ring shape), enabling the production of the pressurized air space surrounding the steam jet 5*a*.

Such a structure also enables the production of the treatment jet 5 according to the invention, described previously in connection with FIG. 1.

It is understood that the foregoing description is that of the preferred embodiments of the invention and that various changes and modifications may be made thereto without departing from the spirit and scope of the invention as defined in the appended claims.

What is claimed is:

1. An installation for cleaning and/or degreasing a manufactured part, the installation comprising:

a system for producing pressurized treatment fluids;

said system including a first device for producing a first one of said pressurized treatment fluids and a second device for producing a second one of said pressurized treatment fluids;

a treatment space for accommodating said manufactured part therein;

an applicator arranged in said treatment space for receiving corresponding ones of said first and second pressurized treatment fluids and for directing said first and second pressurized treatment fluids in the form of a jet to said manufactured part so as to ensure the cleaning and/or degreasing thereof;

said applicator including a first output nozzle connected to said first device and said first output nozzle being configured to form a central jet of said first pressurized treatment fluid;

said applicator further including a second output nozzle connected to said second device and said second output nozzle being configured to form a peripheral annular jet of said second pressurized treatment fluid surrounding said central jet;

said first and second nozzles being mounted in said applicator so as to cause said central jet and said annular jet to flow mutually separate and unobstructed from said applicator into said treatment space;

said first and second nozzles being arranged with respect to each other so as to spray said jets as a composite treatment jet onto said manufactured part; and said composite treatment jet being comprised of said central jet of said first pressurized treatment fluid and said peripheral annular jet of said second pressurized treatment fluid with said peripheral annular jet being adjacent to and separate from said central jet thereby cleaning and/or degreasing said manufactured part.

2. The installation of claim 1, wherein said first pressurized treatment fluid is pressurized steam and said second pressurized treatment fluid is pressurized air so as to cause said central jet to be a jet of pressurized steam and said peripheral annular jet to be a jet of pressurized air disposed in surrounding relationship to said central jet of pressurized steam.

3. The installation of claim 2, wherein said second nozzle is configured as an outlet ring surrounding said first nozzle so as to form said peripheral annular jet in surrounding relationship to said central jet.

4. An installation for cleaning and/or degreasing a manufactured part, the installation comprising:

a system for producing pressurized treatment fluids;

said system including a first device for producing a first one of said pressurized treatment fluids and a second device for producing a second one of said pressurized treatment fluids;

a treatment space for accommodating said manufactured part therein;

an applicator arranged in said treatment space for receiving corresponding ones of said first and second pressurized treatment fluids and for directing said first and second pressurized treatment fluids in the form of a jet to said manufactured part so as to ensure the cleaning and/or degreasing thereof;

said applicator including a first output nozzle connected to said first device and said first output nozzle being configured to form a central jet of said first pressurized treatment fluid;

said applicator further including a second output nozzle connected to said second device and said second output nozzle being configured to form a peripheral jet of said second pressurized treatment fluid;

said first and second nozzles being arranged with respect to each other so as to spray said jet as a composite treatment jet onto said manufactured part consisting of a central jet of said first pressurized treatment fluid and a peripheral jet of said second pressurized treatment fluid surrounding said central jet thereby cleaning and/or degreasing said manufactured part;

said first pressurized treatment fluid being pressurized steam and said second pressurized treatment fluid being pressurized air so as to cause said central jet to be a jet of pressurized steam and said peripheral jet to be a jet of pressurized air disposed in surrounding relationship to said central jet of pressurized steam;

said second nozzle being configured as an outlet ring surrounding said first nozzle so as to form said peripheral jet in surrounding relationship to said central jet;

said applicator comprising an applicator head including a body composed of an upstream socket and a downstream skirt;

said body including an upstream/downstream through-housing for facilitating a circulation of the pressurized air;

said skirt including an inner surface defining an internal volume;

said first nozzle defining a distributor including a plurality of distributor nozzles and said distributor being arranged in said internal volume;

said distributor including a plurality of distributing ducts each having two ends: an upstream end connected to said first device and a downstream end terminated by a corresponding one of said distributor nozzles;

said applicator further comprising a peripheral duct for the movement of the pressurized air that is delimited by the outer surface of said distributor and the inner surface of said skirt; and said peripheral duct being terminated downstream by an annular outlet for the pressurized air.

5. The installation of claim 4, wherein said applicator further comprises a chamber in said applicator head; the upstream ends of the distributing ducts communicate with said chamber; and said chamber forms a collector connected to said first device.

6. The installation of claim 3, wherein said applicator comprises an applicator head including a body composed of an upstream socket and a downstream skirt; said body includes an upstream/downstream through-housing for facilitating the circulation of the pressurized air; said skirt includes an inner surface defining an internal volume; said first nozzle defines a distributor delimiting a single distributor duct having a downstream end forming an outlet nozzle; and, said distributor includes means for adjusting the cross section of said outlet nozzle; said distributor duct has an outer surface; and, said applicator further comprises a peripheral duct for the movement of the pressurized air that is delimited by said outer surface of said distributor duct and said inner surface of said skirt.

7. The installation of claim 1, further comprising:

an enclosure defining said treatment space;

said applicator being arranged in said enclosure wherein said treatment fluids collect during said cleaning and/or degreasing of said manufactured part;

a discharge for conducting said treatment fluids out of said enclosure; and, an assembly coupled to said discharge and being configured to recover said fluids and/or thermal energy contained in said enclosure.

8. The installation of claim 1, wherein said central jet and said peripheral annular jet conjointly define an annular interface wherein the internal contour of said peripheral annular jet substantially matches the external contour of said central jet.

9. The installation of claim 1, wherein said central jet and said peripheral annular jet conjointly define an annular gap therebetween wherein the internal contour of said peripheral annular jet is disposed at a distance from the external contour of said central jet.

10. The installation of claim 1, wherein said applicator has a discharge end; and, said first and second output nozzles conjointly define a plane at said discharge end perpendicular to said composite treatment jet.

* * * * *